US007926421B2

(12) United States Patent
Eckert

(10) Patent No.: US 7,926,421 B2
(45) Date of Patent: Apr. 19, 2011

(54) PRINTING PRESS SYSTEM

(75) Inventor: Günther Oskar Eckert, Zellingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 236 days.

(21) Appl. No.: 12/086,611

(22) PCT Filed: Dec. 7, 2006

(86) PCT No.: PCT/EP2006/069410

§ 371 (c)(1),
(2), (4) Date: Jun. 16, 2008

(87) PCT Pub. No.: WO2007/068643

PCT Pub. Date: Jun. 21, 2007

(65) Prior Publication Data

US 2009/0031906 A1 Feb. 5, 2009

Related U.S. Application Data

(60) Provisional application No. 60/750,357, filed on Dec. 15, 2005.

(30) Foreign Application Priority Data

May 3, 2006 (DE) ..... 10 2006 020 322
Aug. 17, 2006 (DE) ..... 10 2006 038 641

(51) Int. Cl.
*B41F 35/00* (2006.01)

(52) U.S. Cl. ..... 101/424.1; 101/227

(58) Field of Classification Search ..... 101/424.1, 101/227

See application file for complete search history.

(56) References Cited

U.S. PATENT DOCUMENTS 1,972,506 A 9/1934 Wood
(Continued)

FOREIGN PATENT DOCUMENTS

DE 40 12 396 A1 10/1991
(Continued)

OTHER PUBLICATIONS

Braun, Alexander, "Atlas des Zeitungs- und JIlustrationsdruckes," Polygraph Verlag GMBH (Frankfurt am Main), (1960).

(Continued)

*Primary Examiner* — Anthony H. Nguyen
(74) *Attorney, Agent, or Firm* — Jones, Tullar & Cooper, P.C.

(57) ABSTRACT

A printing press system includes a first machine line of a printing press, which is embodied as a newspaper printing press, and is provided with at least one first printing unit having printing group cylinders of a first maximum effective printing width. A second printing press, which is equipped with at least one second printing unit with printing group cylinders that have a second maximum effective printing width, is part of the first machine line. A dryer is located in alignment with the second printing unit. A former structure, having an effective width that is defined by the width of one, or of several formers disposed next to each other, and perpendicular to the feeding direction of the web to be folded, is also provided in the printing press system. At least one turning device is usable to transfer a web or a printed web, which has been printed in the first printing unit, to the former station. The first maximum effective width of the first printing unit is greater than the second effective width of the second printing unit. The maximum effective width of the former structure is the same as the maximum effective printing width of the narrower printing unit.

7 Claims, 7 Drawing Sheets

U.S. PATENT DOCUMENTS

| | | | | |
|---|---|---|---|---|
| 2,400,966 | A * | 5/1946 | Zuckerman | 101/180 |
| 2,868,539 | A * | 1/1959 | Koons et al. | 270/41 |
| 2,920,887 | A | 1/1960 | Keightley | |
| 5,117,753 | A | 6/1992 | Mamberer | |
| 5,676,056 | A | 10/1997 | Stein et al. | |
| 6,142,074 | A * | 11/2000 | Flament | 101/219 |
| 6,644,184 | B1 * | 11/2003 | Hajek et al. | 101/177 |
| 6,647,849 | B2 * | 11/2003 | Jones | 83/698.42 |
| 6,892,635 | B2 | 5/2005 | Herbert | |
| 6,892,639 | B2 * | 5/2005 | Compton et al. | 101/424.1 |
| 6,899,026 | B2 * | 5/2005 | Weis | 101/225 |
| 7,040,133 | B2 * | 5/2006 | Hu | 72/149 |
| 7,159,514 | B2 | 1/2007 | Eckert et al. | |
| 7,523,925 | B2 * | 4/2009 | Herbert et al. | 270/5.02 |
| 2005/0016401 | A1 * | 1/2005 | Takahashi et al. | 101/424.1 |
| 2006/0187472 | A1 | 8/2006 | Elschner et al. | |

FOREIGN PATENT DOCUMENTS

| | | | |
|---|---|---|---|
| DE | 102 36 864 | A1 | 3/2004 |
| DE | 102 38 010 | A1 | 3/2004 |
| DE | 20 2005 010 058 | | 11/2005 |
| EP | 0 741 020 | A2 | 11/1996 |
| EP | 1 683 634 | A1 | 7/2006 |
| WO | WO 03/031182 | A1 | 4/2003 |
| WO | WO 2004/024448 | A1 | 3/2004 |

OTHER PUBLICATIONS

Kipphan, Helmut (HRSG.), "Handbuch der Printmedien, Technologien und Produktionsverfahren," Springer, (2000).

* cited by examiner

PRINTING PRESS SYSTEM

CROSS-REFERENCE TO RELATED APPLICATIONS

This application is the U.S. national phase, under 35 USC 371, of PCT/EP2006/069410, filed Dec. 7, 2006; published as WO 2007/068643 A1 on Jun. 21, 2007 and claiming priority to U.S. Pat. No. 60/750,357 filed Dec. 15, 2005; to DE 10 2006 020 322.4, filed May 3, 2006 and to DE 10 2006 038 641.8, filed Aug. 17, 2006, the disclosures of which are expressly incorporated herein by reference.

FIELD OF THE INVENTION

The present invention is directed to a printing press system, and especially to such a system for use in newspaper and semi-commercial printing. The system includes a first machine line with a first printing press configured as a newspaper printing press. A second printing press, which has a maximum width less than a corresponding maximum width of the first printing press, is used in cooperation with the first printing press.

BACKGROUND OF THE INVENTION

A printing press that has both printing units for newspaper printing and a printing unit for printing semi-commercial products is known from DE 102 38 010 A1. Production is performed on a shared folding unit, which has a newspaper folder and an illustration folder.

WO 2004/024448 A1 describes a printing press having a plurality of printing units, at least one dryer and one folding unit. Printing units are arranged side by side, in terms of the axial direction of their cylinders. A web path from the printing units to a former assembly, which former assembly has three fold formers side by side, has a 90° turn that projects into a horizontal plane.

In WO 03/031182 A1, there is described a printing press with a plurality of printing towers for printing newspaper products. The printing towers of this printing press are arranged in a machine alignment that is perpendicular to the axial direction of their printing group cylinders, so that the printing press is configured as a so-called linear machine. A lead-in direction to fold formers of a former assembly, which is assigned in straight-line travel, also extends along, or at least parallel to, the machine alignment.

Two printing machine lines, each with a plurality of printing groups, which are arranged side by side and through which a web passes in sequence, is known from DE 40 12 396 A1. Auxiliary devices of the one printing press can be used by transferring the web to the other printing press.

In U.S. Pat. No. 1,972,506 A there is described a printing press having a plurality of printing groups, which are arranged side by side, and an aligned former assembly. From printing groups that are offset 90° from the first machine alignment, partial webs that have been printed in a multicolor process are fed to the former assembly of the first machine.

DE 20 2005 010 058 U1 and EP 16 83 634 A1 each show a printing press with two printing press subsystems. The printing press subsystems are differently configured such that webs of printing substrate can be printed in them, thus producing a varying number of printed pages.

DE 102 36 864 A1 discloses a printing press having a plurality of lines side by side. Each line has one printing unit, one dryer and one cooling roller assembly. After passing through the respective line, a web is turned 90° on a turning bar into a direction of transport. The turned web is fed to a former assembly that has three formers arranged side by side.

In the publication "Handbook of Print Media"; by Helmut Kipphan; Springer, 2000; pp 357 and 358, examples of printing presses or of printing press systems with combined heatset/coldset machine lines are presented.

The publication "Atlas of Newspaper and Illustration Printing"; by Alexander Braun; Polygraph, 1960, shows, on page 152, a printing press with a printing group that is four plates wide, and with a double-width former assembly with a folding unit arranged downstream from it. Webs that are one page wide and which have been printed by printing groups that are offset 90° from the first machine can be fed, from a cover or a supplemental machine, to the folding unit of the first-mentioned machine.

SUMMARY OF THE INVENTION

The object of the present invention is to provide a printing press system, especially such a printing press system that is particularly usable for printing a variable product configuration.

The object is attained according to the invention by the provision of a printing press system that includes a first machine line of a printing press, which is configured as a newspaper printing press and which has at least one first printing unit with printing group cylinders of a first maximum effective printing width. A second printing press has at least one second printing unit with printing group cylinders whose second maximum printing width is less than the first. A former assembly is provided in the printing press system and has an effective former width that is determined by the widths of one or more fold formers in the former assembly. At least one web or partial web turning device is provided before the former assembly. The effective former width is no greater than the second maximum printing width.

The benefits to be achieved with the present invention consist, in particular, in that the arrangement of two different printing presses, in a printing press system, allows for the widest range of hybrid products to be produced in a simple and variable manner. By combining, for example, types of printing presses or printing units that are different from one another, the widest range of requirements, in terms of product diversity and quality, can be accommodated. For example, high-quality heatset products can be produced separately, and, in so-called "hybrid production," hybrid products, which are comprised of both heatset and coldset pages, can also be produced. "Heatset" in this context will be understood to refer to other web drying processes in addition to thermal drying.

In such hybrid production, it is possible, for example, to add coversheets from a heatset machine to broadsheet products coming from a coldset unit. In tabloid production, coldset tabloid products can also be provided with heatset coversheets or with heatset panorama pages on the inside of the product. In this process, for example, a coldset web, and having the full width, is cut at least once lengthwise after printing, and before being fed to the heatset machine printed ribbon in a superstructure of the printing press system.

With the printing press system, in accordance with the present invention, an outer printed section can be formed for the widest range of coldset partial products using high-quality heatset partial webs, without great complication in terms of the web lead.

In the situation of an orthogonal machine configuration, it is advantageous that the more sensitive web, which more sensitive web is printed in the heatset process on suitable paper, need not be regularly fed over the turning bars. Instead, this more sensitive web can be fed, in straight-line travel, to the former assembly.

A printing press system with, for example, a newspaper printing press and a printing press that differs from the newspaper press, in terms of the number of pages and/or the printing process and/or the drying option, is therefore structured, in accordance with the present invention, such that, in addition to solely newspaper production, "improved" newspaper products or hybrid products can also be produced.

In one particularly advantageous embodiment of the present invention, webs and/or partial webs are fed from a triple-width printing unit to a former assembly that is only double width. The high productivity that is typical of the triple-width printing units is thereby combined with the flexibility and variability of a double-width superstructure and former assembly.

BRIEF DESCRIPTION OF THE DRAWINGS

Preferred embodiments of the present invention are represented in the set of drawings and will be described in greater detail in what follows.

The drawings show.

DESCRIPTION OF THE PREFERRED EMBODIMENTS

Figure 1:
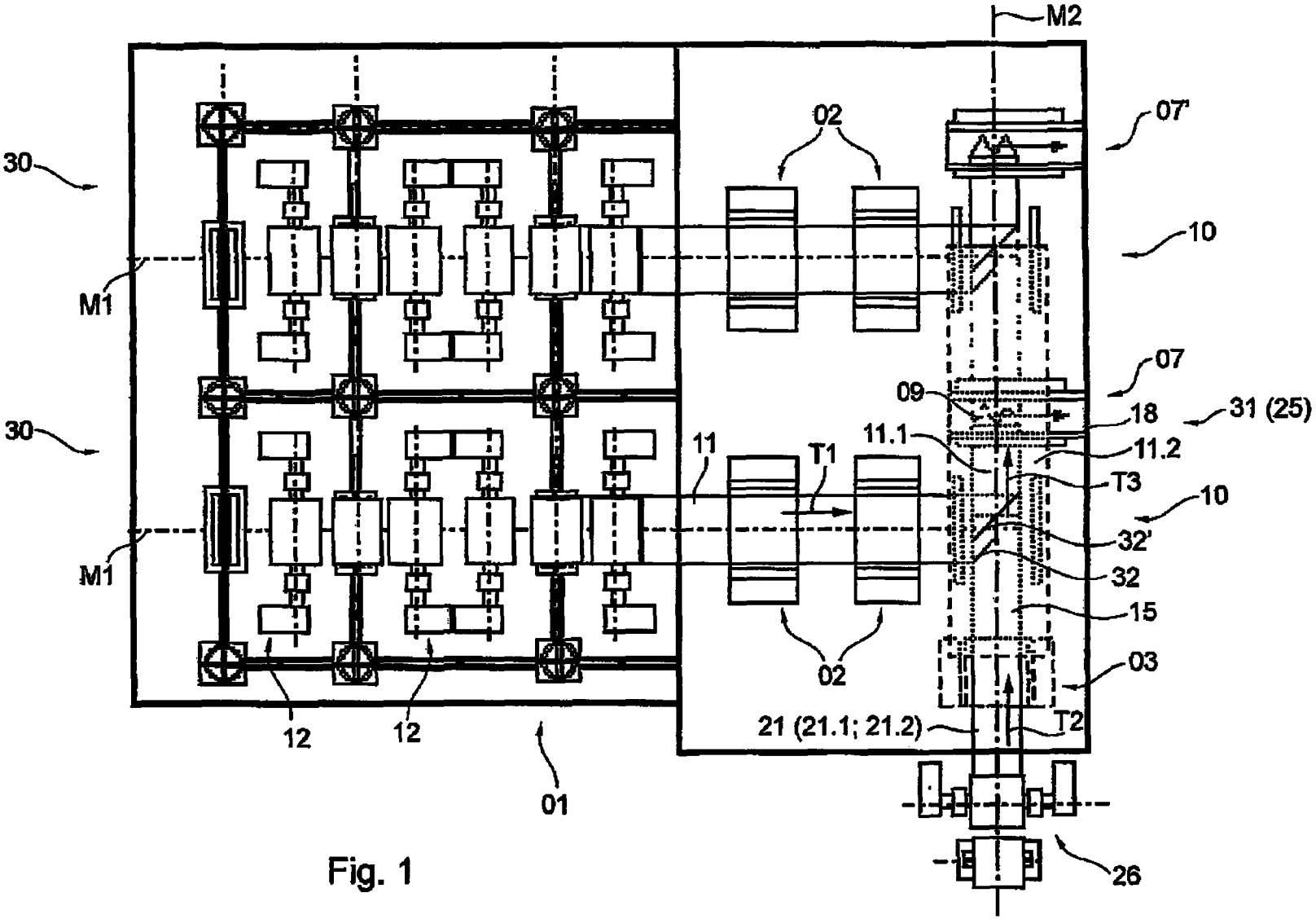
FIG. 1 a schematic top plan view of a first preferred embodiment of a printing press system in accordance with the present invention.

Referring initially to FIG. 1, there is shown a schematic top plan view of a first preferred embodiment of a printing press system in accordance with the present invention. In addition to the provision of one or more printing units 02 of a first type, or first printing units 02 in a first printing press 01, one or more printing units 03 of a second type, or second printing units 03, in a second printing press 31 are provided. The first printing units 02 and the second printing units 03 are oriented laterally, and are especially oriented, in relation to one another, in a manner that will be described in greater detail in what follows.

Particular advantages, with respect to product configuration, are achieved when the two types of printing units 02; 03 are different from one another, with these differences being based typically upon printing requirements.

Figure 2:
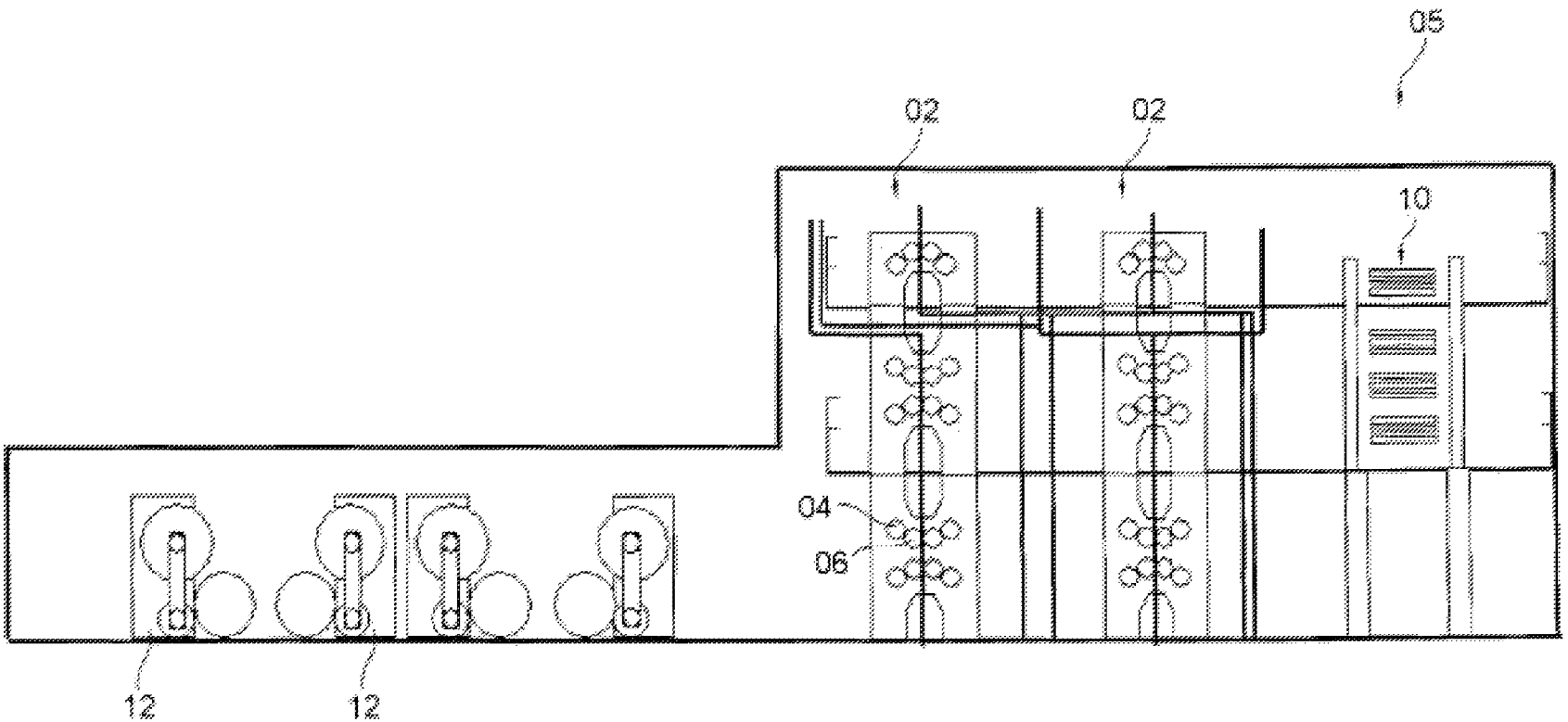
FIG. 2 a first side elevation view of the printing press system of FIG. 1.
Figure 3:
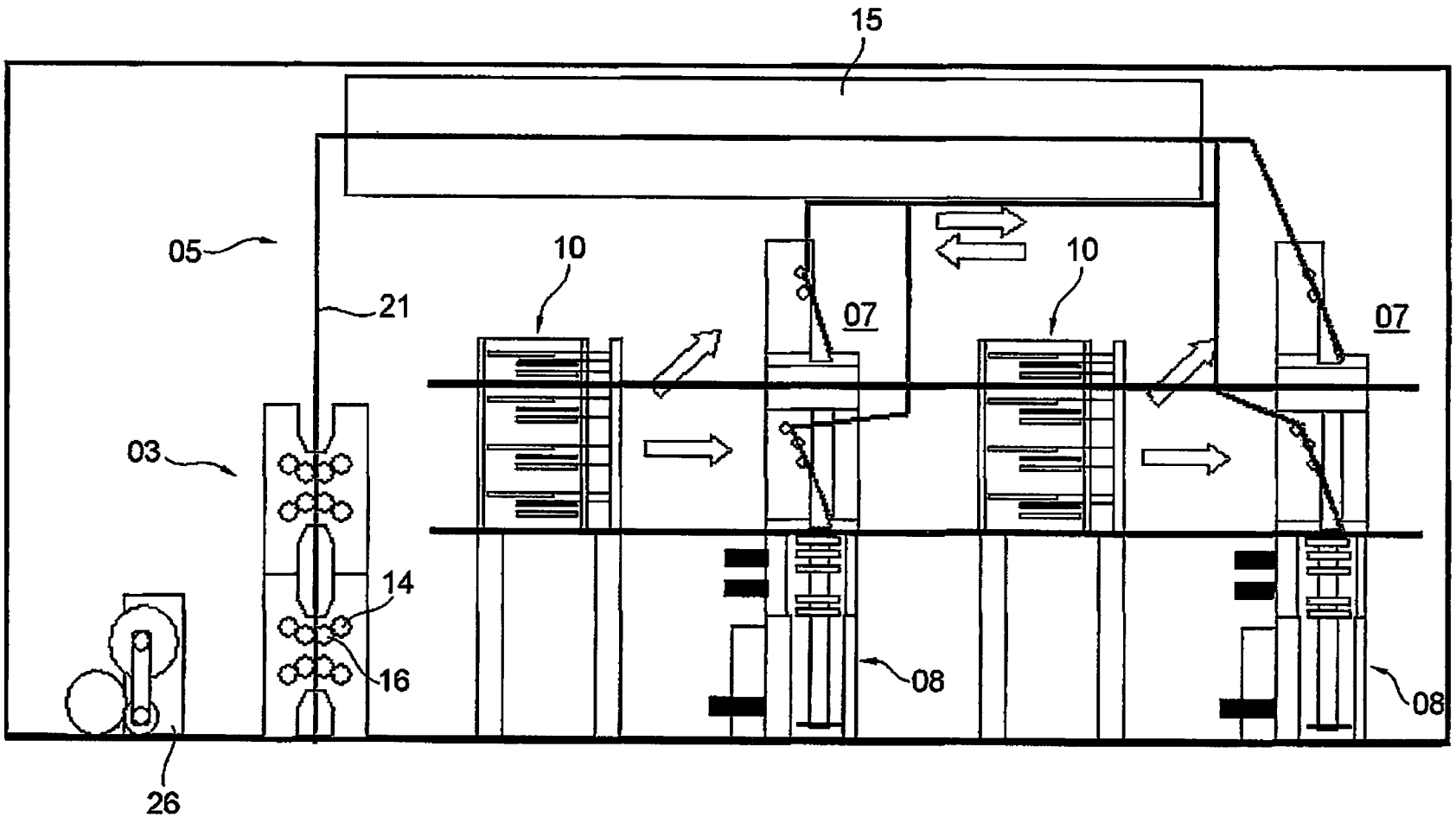
FIG. 3 second side elevation view of the printing press system of FIG. 1.

The two types of printing units 02; 03 and/or the two printing presses 01; 31 differ in terms of the width and/or the circumference of their imaging printing group cylinder 04; 14, as seen in FIGS. 2 and 3. These differences are in terms of the maximum length of the imaging printing group cylinders 04; 14 that is actively used for printing and/or in terms of the circumference of the imaging printing group cylinder 04; 14, such as, for example, of forme cylinder 04; 14, as will be discussed below. In other words, these imaging printing group cylinders 04; 14 are each configured with a length and/or a circumference which corresponds to a different number of printed pages of the same format, such as, for example, newspaper pages in broadsheet format, and/or which supports a different number of print pages on the forme cylinder 04; 14. For example, the printing unit 02; 03 of the one type can be configured to have printing group cylinders 04; 14 that are the width of four printed pages, especially four newspaper pages, and which are referred to as "double width" cylinders and, at least the forme cylinder 04 can be provided with a circumference that corresponds to the length of two printed pages and is thus a "double circumference" cylinder, and corresponding especially to the length of two newspaper pages in "double circumference", and thus is provided in a so-called "4/2" configuration. The printing unit 03; 02 of the other type can be structured in a 4length/1circumference of at least the forme cylinder 14; 04 configuration, in a 2/2 configuration, with "single width" and "double circumference" or in a 6/2 configuration, with "triple width" and "double circumference". With the provision of a single-circumference configuration, a printing group cylinder 06; 16, such as, for example a, transfer cylinder 06; 16, as will be discussed below, that cooperates with the "single-circumference" forme cylinder 04; 14 can also be configured as double circumference. In principle, the one printing press 01; 31 can be structured as any one of the configurations 2/1, "single width" and "single circumference", 2/2, "single width" and "double circumference", 4/1, "double width" and "single circumference", 4/2, "double width" and "double circumference", 6/1, "triple width" and "single circumference", 6/2, "triple width" and "double circumference". The other printing press 31; 01 can be structured as one of the above-listed configurations, that is different from the first. A wider, for example, double-width, printing unit 02 can also be single circumference, 4/1 configuration, and the printing unit 03 of the second type can be configured as single width and double circumference, 2/2 configuration. In general terms, in an x/y configuration, the forme cylinder 04; 14 of the relevant printing unit 02; 03 supports a number "x" of print images side by side lengthwise along its circumference, and a number "y" of print images in a circumferential direction, or supports the equivalent number of printing forms, such as, for example, printing plates, each with one print image, in the respective format, such as, for example, in tabloid format or in newspaper format, and especially in broadsheet format, in the case of newspaper format.

In the selection of the configuration of the printing press 01; 31, with respect to the differentiation in circumference, such as a single-circumference or double-circumference configuration, a single circumference configuration, such as, for example, 2/1, 4/1 or 6/1, can offer advantages in terms of the printing forms that must be changed with a shift in production, and/or in terms of the page jump in the product to be produced and/or in a machine height. A double-circumference configuration, such as, for example, 2/2, 4/2, 62, however, can offer advantages with respect to a maximum product thickness that can be produced in collect-run production. With respect to differentiation in the printed pages which are arranged side by side lengthwise, the product thickness and/or the efficiency to be achieved is also a decisive criterion. For example, if only a small number of special sections are required in the hybrid product, and if, in stand-alone production using this, for example, second printing press 03, only products of small circumference are required, then, for example, a single- or double-width configuration of the second printing unit or units 03 may be sufficient. This second printing unit 03 is combined with wider first printing unit 02, such as, for example, of a triple-width configuration, to produce the multiple-page inner sections. Thus, in the case of configurations of the two types of printing units 02; 03, which have different widths and/or which differ in terms of circumference, an adjustment to the requirements of a certain product spectrum can be specifically performed.

In the advantageous combination, which is described in connection with the several depicted preferred embodiments, and in a hybrid production process, at least one first printing unit 02, which is configured as a triple-width printing unit 02, coordinates with at least one second printing unit 03, which is configured as a double-width printing unit 03.

With a triple-width configuration, such as 6/1 or 6/2, one of the printing units 02; 03 and/or one of the printing presses 01; 31 can have on its transfer cylinder 06; 16, which is six printed pages wide, and which may carry one printing blanket that is continuous over its entire length, alternatively may carry two printing blankets, each three pages wide, or may carry three printing blankets, each two pages wide, all of which are not specifically shown. Such printing blankets are especially configured as metal printing blankets, each with a dimensionally stable support plate, such as, for example, with a metal plate, and having an overlying flexible and/or compressible coating. The configuration comprising two rubber blankets, each of which is three pages wide, and which are arranged side by side lengthwise offers advantages in terms of increased variability, such as, for example, in pop-up production, or in variable web width. The printing blankets, which may be rubber blankets, can each be offset over their entire circumference and, if there is a plurality of such blankets located side by side lengthwise, circumferentially in relation to one another.

The two types of printing units 02; 03 and/or of printing presses 01; 31, in addition to their differentiation in terms of cylinder width and/or circumference, can also differ from one another, for example, in terms of their respective printing process. For example, the printing unit 02 of the one type can be configured as an offset printing unit, as a direct printing unit, as a flexo printing unit, or as a printing unit that employs a non-impact process, which is defined as a printing process without a printing forme, and/or as an inking process without the mechanical action of printing cylinders on the printing substrate, such as, for example, printing on photosensitive paper, ink-jet printing or laser printing, and the printing press 01 can be operated under the corresponding process. The printing unit 03 of the other type can then be configured according to another of the above-listed processes. For example, the one printing press 01 can preferably be configured as a newspaper printing press 01, with offset printing units, while the other printing press 31 has one or more direct printing or flexo printing units or non-impact printing units. One printing press 01 may also be configured as a newspaper printing press 01 with offset printing units, while the other printing press 31 may be configured having offset printing units for commercial printing 03, or in other words, having printing groups 03 having an essentially horizontal web path for high-quality commercial printing, with a dryer downstream, or may be configured as a commercial printing press.

The two types of printing units 02; 03 or the two types of printing presses 01; 31 can preferably differ from one another, in addition to, or in place of a difference in the aforementioned printing process, in that one of the printing presses 01; 31 is being operated with a drying of the freshly printed web, and is thus set forth as using the "heatset" process, which term "heatset" will be described below, while the other one of the printing presses 01; 31 is operated without drying, for example, using the "coldset process." The printing press 31; 01 that operates using the heatset process then has suitable drying capabilities 15, such as, for example, a dryer 15, and the associated printing units 03; 02 are configured with correspondingly modified units and/or with supplementary equipment, as will be seen below. Especially advantageously, one printing press 01 can also be configured as a newspaper printing press 01 with offset printing units that are configured solely for newspaper printing and/or coldset printing, coldset printing units 02, while the other printing press 31 has one or more offset printing units which may be configured for semi-commercial and/or for "heatset printing," heatset printing units 03, and a drying device 15. The prefix "heatset" here refers not only to drying the web using a thermal process, but, in contrast to the "coldset" process, also includes drying using other drying expedients, such as, for example, UV or IR dryers.

A plurality of printing units 02 of the first type, such as, for example, "dedicated" coldset printing units 02, are arranged, for example, in the manner of a so-called linear machine 01, and are thus in a shared machine alignment M1, which machine alignment M1 is perpendicular to the axial direction of its printing group cylinders 04; 06. The machine alignments M1 of the first printing press, or the first linear machine 01, as represented in the figures, extend at the level of a plane of symmetry that divides the printing group cylinders 04; 06 in half lengthwise, and, in this configuration, can also be characterized as machine center alignment M1. In a further improvement, in accordance with the present invention, and that is not specifically shown here, with a plurality of printing units 02 of the first type in linear arrangement, a former assembly, which is assigned to these printing units 02, can also be arranged in this machine alignment M1, for the accomplishment of a "straight-line configuration" of these webs from the first printing units 02 in a possible stand-alone production process.

In the case of offset printing, the printing group cylinders 04; 06 of the first printing unit 02 are configured, for example, as forme cylinders 04, or as imaging printing group cylinders 04, and transfer cylinders 06. Material webs 11, such as, for example, paper webs 11, or webs 11, which have been printed in the first printing units 02, have a direction of transport T1 in the first printing press 01, as projected into the horizontal plane, for example, which depiction of transport T1 extends along, or is parallel to the machine alignment M1 of the first printing press 01. The first printing press 01, which is configured as a linear machine 01, or a section with at least one printing unit 02 with assigned web lead elements, can also be characterized as a first machine line 30.

The first printing press 01 preferably has a plurality of spaced first machine lines 30, as viewed in the axial direction of their printing group cylinders 04; 06, as is depicted in FIG. 1. In principle, the printing press system can comprise any above-mentioned combination of two different printing units 02; 03 and/or printing presses 01; 31. However, the printing units 02 of the first printing press 01 are preferably configured as printing towers 02, each of which advantageously has at least eight printing points, four each on each side of the web 11. For example, these printing towers 02 each have two stacked H-printing units or two stacked satellite printing units, all as seen in FIG. 2. In principle, the printing towers 02 can also have four blanket-to-blanket printing groups for double-sided printing. The web 11 then runs essentially vertically between the printing points in the printing units 02 of the first printing press 01. As shown in FIG. 2, in addition to the eight printing points of the stacked H, either satellite or bridge printing units, two additional printing points, such as, for example, in the form of an additional stacked bridge printing unit, can be provided in the printing tower 02.

A machine alignment M2 of the second printing press 31 and/or machine line 30, as shown in FIG. 1, for example, extends at the level of a plane of symmetry that divides the printing group cylinders 14; 16 of the second printing unit 03 in half lengthwise, and can also be characterized, in this configuration, as machine center alignment M2.

In one advantageous configuration of the one printing press 01 as a "dedicated" newspaper printing press 01, this printing press 01 has coldset printing units 02 for newspaper printing as the printing units 02 of the first type. With these first type of printing units 02 configured as coldset printing units 02, especially for newspaper printing, the printing group cylinders 04, which are configured as forme cylinders 04, have on their circumference, as viewed longitudinally, a plurality of printing forms, in this case six such printing forms, for example, which, in an axial direction, support either only one print image, in the case of a single printing forme, which is not specifically shown, or a maximum of two print images, in a panorama printing forme for one newspaper page, while circumferentially around the forme cylinder 04 they support only one of these print images. Thus, the forme cylinder 04 supports six printing forms, for example side by side in an axial direction, and, in the case of a double-sized forme cylinder 04 supports two printing forms in a circumferential direction, each such printing forme bearing an image of one printed page.

Single-sized forme cylinders 04 have only one printing forme of this type in a circumferential direction. The individual printing formes can be replaced separately or also together in pairs by panorama printing formes, which panorama printing formes are two printed pages in width. For facilitating this printing forme attachment and replacement, the forme cylinder 04 of the coldset printing unit 02 has, on its circumference, for example, one channel 05, as may be seen in FIG. 8, in the embodiment as a single-sized forme cylinder 04 or two channels in tandem, in the embodiment as a double-sized forme cylinder 04, with these channels each extending longitudinally over the entire usable printing length, and structured for the purpose of holding the printing formes on the forme cylinder. The forme cylinder 04 of the coldset printing unit 02 further has, for example, devices, such as registers or axially active stops for accomplishment of the lateral alignment of four printing formes side by side. The configuration of the forme cylinder 04 described for six print pages, which has six print pages or printing formes side by side and also has six stops, can be correspondingly applied to a forme cylinder 04 with four print pages side by side, giving it four printing formes and four stops.

A printing unit 02, which is configured as a coldset printing unit 02, has an inking unit, not shown in FIG. 2, for use in the inking of the printing forms, which inking unit is filled and/or is operated using coldset inks. The coldset ink is characterized by special auxiliary substances such as, for example, surfactants, wax gelating agents, mineral fillers and the like, which enable the printed web 11 to dry by causing the ink to be absorbed into the paper. This is achieved especially through the special combination of the coldset ink and the paper that is used.

The web 11 that is fed through the coldset printing unit 02 is preferably uncoated or lightly coated paper having a maximum coating weight of 20 g/m$^2$, and especially having a coating weight of at most 10 g/m$^2$.

Figure 8:
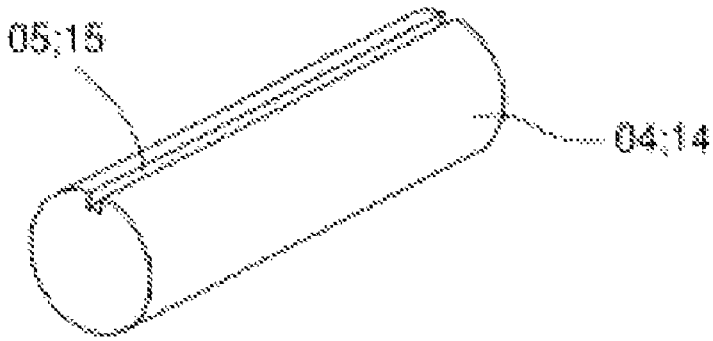
FIG. 8 a schematic perspective view of a forme cylinder with a plate and retaining channel.

In one configuration, printing group cylinders 14 of a heatset printing unit 03 for semi commercial printing, which are configured as forme cylinders 14, can advantageously have only one, but, at the most, can have two printing formes on their circumference, as viewed longitudinally. These printing formes as viewed axially, support, for example, at least three, in the case of two printing formes longitudinally or, for example, support six, in the case of only one printing forme longitudinally, print images of a tabloid page, such as, for example, a magazine or telephone book page, and, viewed in the circumferential direction of the forme cylinder 14, support a plurality, such as, for example, at least four of these print images. For example, the forme cylinder 14 supports only one printing forme, viewed both axially and circumferentially. That printing forme bears, for example, the print images of six print pages side by side and circumferentially bears the images of four print pages in tabloid format, or in other words in magazine or in telephone book format. In the case of two full-circumference printing formes situated side by side on the form cylinder 14, for example, the printing formes each have three print pages arranged side by side in tabloid format. For accomplishing this forme positioning, the forme cylinder 14 of the heatset printing unit 03 has on its circumference, for example, one channel 15, extending longitudinally over its entire usable printing length, and configured for the purpose of holding the printing formes, as is also depicted in FIG. 8. The forme cylinder 14 of the heatset printing unit 03 also has, for example, a device, such as, for example, one or more registers or axially active stops, for use in accomplishing the lateral orientation of one or two printing formes side by side.

In another configuration, the printing unit 03, that operates using the heatset process, can be configured with its forme cylinder 14 corresponding to a forme cylinder 04 of a coldset printing unit 03, which forme cylinder 04 can support a number of printing forms, such as, for example, individual printing plates, axially on its circumference, with that number of printing forms corresponding to the number of print pages. In the case of a double-width printing unit 03, the forme cylinder 04 can be configured with four printing forms situated side by side in an axial direction, and in the case of a triple-width printing unit 03, with six printing forms with print pages, for example, in newspaper format.

The forme cylinder 14 of the heatset printing unit 03 can, for example, have an effective cylinder width, which is a width that is usable for printing a material web 21, such as a paper web 21, or another type of web 21, which corresponds at least to the corresponding number of newspaper pages of the format to be printed in the newspaper printing press 01.

The heatset printing unit 03, or the printing unit 03 which is being operated using the heatset process, has an inking unit, which is not specifically represented in FIG. 3, for use in inking the printing forms, which inking unit is filled and/or is operated using heatset inks in at least one operating mode, such as in heatset operation. The heatset ink is characterized by special oils, such as, for example, mineral oils, which evaporate under the influence of heat, thereby allowing the printed web 21 to dry. The mineral oils, for example, have a boiling range of 220° C.-320° C. Their part by weight can be approximately 25 to 40%, referred to the ink. Because the ink does not need to be absorbed in order to dry, paper surfaces having smaller pores can also be printed on.

The web 21, which, in the heatset process, is fed through the second printing unit 03, is preferably satin-finished and/or is relatively heavily coated paper, preferably having a coating weight of more than 10 g/m$^2$, and, for example, of at least 15 g/m$^2$. At average or higher quality, the paper can be structured in a base weight range of greater than 40 g/m$^2$, and preferably in a base weight range of 55-90 g/m$^2$, and most particularly greater than 50 g/m$^2$. In contrast, the paper used in the coldset process can advantageously be provided within a base weight range of less than 50 g/m$^2$, and particularly of especially less than 40 g/m$^2$.

Preferably, the heatset printing unit 03 can be operated in either heatset mode or in coldset mode, as desired. It is operated, for example, in the heatset operating mode, using heatset ink and/or using heavily coated paper. It is operated, in the coldset operating mode, using coldset ink and/or using uncoated or lightly coated paper. In the coldset operating mode, the dryer 15 can be traversed in deactivated status, or can be circumvented in a modified web path.

The printing unit 03 of the second machine line 25, and especially of the heatset machine line 25 and/or the second printing press 31, which is configured as a heatset and/or as a semi-commercial printing press, is configured, for example, as a printing tower 03, which preferably has two stacked H-printing units, as depicted in FIG. 3. In principle, the printing tower 03 can also have four stacked blanket-to-blanket printing units for use in double-sided printing, for example, can have so-called bridge or n-printing units, or can have two stacked satellite printing units, or can be comprised of both of these.

If the second printing press 31 is configured as a commercial printing press, the printing unit 03 has an offset blanket-to-blanket printing group with four printing groups cylinders 14; 16 arranged vertically, one above the other, as seen in FIG. 3, and also has more complicated inking groups, such as, for example, dual-train roller inking groups with at least three friction cylinders located in the roller train. Such inking groups are not specifically shown in the drawings. The forme cylinders 14 are configured, for example, in a manner that is similar to those described above, in reference to the heatset printing group, with a continuous mounting channel 15, as seen in FIG. 8, and with the option of attaching a printing forme that extends over the entire width. In this case as well, the commercial printing units are operated using heatset ink, and the printing press has a dryer 15. In the configuration of the second printing press 31 as a commercial printing press, it has, for example, a plurality of printing units 03 positioned side by side in a horizontal direction, through which a web 21 passes in sequence.

A machine alignment M2, that is perpendicular to the axial direction of the printing group cylinders 14; 16 of the printing units 03 of the second printing press 31, can have either only one second printing unit 03 arranged in it, or can have a plurality of printing units 03 of the second type, in the manner of a linear machine, or can have at least one second printing unit 03 and one dryer 15 and/or can also have other units, such as cooling rollers and/or a coating unit, which may also be arranged in machine alignment M2. A configuration of this type, comprising one or more second printing units 03, together with, for example, a supplementary dryer 15 and the like, in a machine alignment M2, is also characterized in what follows as a second machine line 25, and in specific cases also as a heatset machine line 25. The machine alignment M2 and/or the direction of web passage through an optionally included dryer 15 is oriented, for example, essentially perpendicular to the machine alignment M1. With a linear arrangement of the first printing press 01, the axial direction of the printing group cylinders 14; 16 of the second printing units 03 extends essentially parallel to the machine alignment M1 of the first printing press 01.

Preferably, in this linear arrangement of the second printing press 31, a former assembly 07 is also arranged in this machine alignment M2 of the second printing press 31. This former assembly 07 is oriented such that a web 21, that has been printed in the printing unit 03 of the second type, can be fed, in so-called "straight-line travel," to the former assembly 07. The former assembly 07 has one or more fold formers 09, which are preferably oriented such that webs 21; 11 running up to the fold formers 09 have a direction of transport T2 that is projected into the horizontal plane and which extends along, or parallel to the machine alignment M2 of the second printing press 03.

A folder 18 is assigned to the at least one former assembly 07, which is arranged in the machine alignment M2, which folder 18, in one configuration, can be structured as a dedicated newspaper folder. The folder 18, which is preferably structured as a newspaper folder, has one or two folding units, and is thus structured, for example, as a single folding unit or as a double folding unit. The folder 18 can also have a plurality of individual folding units. Each folding unit of the folder 08, which is preferably configured as a newspaper folder, has, for example, a cutting cylinder, a transport cylinder, a jaw cylinder and, if applicable, a delivery fan. Optionally, however, and especially if the folding unit is structured for semi-commercial products, it can also have the capability of forming a second cross fold. The folding unit of the folder 08 is advantageously rotationally driven by at least one drive motor, and is mechanically independently separated from the second printing units 02.

In another configuration of the subject invention, the folder 18 may be configured as a heatset folder 18, for semi-commercial products, and advantageously has, in addition to a cutting cylinder, a transport cylinder and a jaw cylinder, additional units, such as, for example, a device for forming a second longitudinal fold and/or for forming a second cross fold and may also include a stitcher and/or a plough fold. It is also possible to provide a folder 18 such that two folding units, for example, a dedicated newspaper folding unit and a heatset folding unit are both included, in the folder 18, together with the above-mentioned additional units. It is also possible to provide a folding unit that can be converted. In one operating mode it is capable of being operated as a newspaper folding unit, without the additional units. In another operating mode, it is operated as a heatset folding unit with, for example, the second longitudinal fold and/or a second cross fold and/or a stitcher and/or a plough fold.

In the preferred embodiments of FIG. 1 through 4, the at least one printing unit 02 of the first type is arranged laterally, to the side of the alignment of the second printing unit 03 and/or of the second printing press 31, as shown in a top plan view in FIG. 1. This means that, from a top plan view, at least the printing points of this first printing unit 02 are located outside of an alignment formed by the effective lengths of the printing group cylinders 14; 16 or by the maximum web width of the second printing press 31. In this way, as will be described below, a web 11 that has been printed by the printing unit 02 of the first type can be fed in from the side, transversely to the machine alignment M2 of the second printing press 31, and into the flow of webs 21 or of partial webs 21.1; 21.2 of the second printing press 31. A direction of transport T1, projected into the horizontal plane, of a web 11 that has been printed by the printing unit 02 of the first type, and which is running up to the second printing press 31, therefore intersects the machine alignment M2 of the second printing press 31, which is projected into the horizontal plane, at a 90° angle. The partial webs 11.1; 11.2 coming from the printing units 02 of the first type are fed to the former assembly 07, a lead-in direction T3 of which former assembly 07, is projected into the horizontal plane and is oriented parallel to the longitudinal direction of the printing group cylinders 04; 06 and/or is perpendicular to the machine alignment M1 of the first printing unit 02.

It is particularly compact and is also advantageous, in terms of the number of changes in direction that are necessary, for the at least one printing unit 02 of the first type to be arranged at an angle, and especially to be arranged at a right angle, relative to the printing unit 03 of the second type and/or to the second printing press 31. The rotational axes of printing group cylinders 04; 06 of the printing units 02 of the first type extend perpendicular or orthogonally to the rotational axes of the printing group cylinders 14; 16 of the printing units 03 of the second type. In this context, the term "perpendicular" or "orthogonal" does not mean that the imaginary straight-line extensions of the rotational axes must intersect; they can also be "skewed" in relation to one another.

A machine alignment M1, that is perpendicular to the axial direction of the printing group cylinders 04; 06 of the printing units 02 of the first type, may have only one printing unit 02 arranged in it, or may have a plurality of printing units 02 of the first type arranged on it, in the manner of a linear machine, as shown in the embodiment depicted in FIG. 1. A configuration of this type, comprising one or more first printing units 02, is also characterized in what follows as machine line 30, and in specific cases also as coldset machine line 30. Here, the machine alignment M1 is oriented, for example, essentially perpendicular to the machine alignment M2.

In the machine alignment M2 of the second printing press 31, and especially in the area of the point at which the two machine alignments M1; M2 intersect, a superstructure 05, with at least one turning device 10, is provided. The turning device 10 is configured such that a web 11, which is entering from the first printing unit 02 and/or which is entering from the first printing press 01, can be turned 90° into an alignment of a web 21 or of a partial web 21.1; 21.2 of the second printing press 31. In other words, with the use of the turning device 10, a web 11 from the first printing press 01, traveling in direction of transport T1, can be turned 90°, to a turned direction of transport T2 that is parallel to the machine alignment M2 of the second printing press 31, and can then be fed to the former assembly 07 of the second printing press 31.

Therefore, with the above-described lateral, or angular, arrangement of the two printing presses 01; 31 and/or of the two printing units 02; 03 of different types, and with the turning device 10, in addition to a printing unit 03 of the second type, a printing unit 02 of the first type, such as, for example, a coldset printing unit 02, is or can be assigned to the former assembly 07 of the second printing press 01.

This turning device 10 can be viewed as a turning device 10 in a superstructure 05 that is assigned to this second printing press 31, with this turning device being assigned to the second printing press 31 in stand-alone production. However, in addition to this turning device 10, another turning device, which is not specifically shown here, can also be advantageously assigned, in the superstructure 05, to the second printing press 31, to allow the webs 21 or the partial webs 21.1; 21.2, that are traveling in the second printing press 31, to be turned variably into different alignments that are parallel to the second machine alignment M2.

In addition to the one former assembly 07 shown in FIG. 1, another, second former assembly 07' is assigned to the two printing presses 01; 31 in the machine alignment M2, as shown in FIG. 1, for example. In one operating mode of the printing press system, stand-alone production can be performed with the one printing press 01 on the one or first former assembly 07, and with the other printing press 31 on the other or second former assembly 07'. In another operating mode of the printing press system, using the at least one turning device 10, and because of the special arrangement of the machines, as described above, it is possible to feed webs 21; 11 or partial webs 21.1; 21.2; 11.1; 11.2; 11.3 from the two printing presses 01; 31 together to one former assembly, either 07 or 07'.

Depending upon the machine width, specifically the maximum web width to be printed and/or the number of pages, such as, for example, newspaper pages the two fold former assemblies 07; 07' can have the same or different numbers of fold formers 09; 09' arranged side by side horizontally as former groups, which are arranged side by side in a direction perpendicular to the machine alignment M2, and/or, depending upon the products to be chiefly produced on the two printing presses in stand-alone production, the two former assemblies 07; 07' can have fold formers 09; 09' of the same or of a different effective width or former format. Thus, for example, one former assembly 07 or 07' can have a group of two fold formers 09 positioned side by side with the other former assembly 07' or 07 can have only one fold former 09' of, for example, a larger format or a group of three fold formers 09; 09' of, for example, a smaller format. In this context, the effective width and/or format of the fold former 09; 09' refers to the width in the run-up area to the fold former 09; 09', transversely to the approaching web 11; 21 or partial web 11.1; 11.2; 21.1; 21.2. This corresponds, for example, to the maximum width of a partial web to be folded using this fold former 09; 09', which, in turn, corresponds to the respective print page format to be folded. Generally, a partial web to be folded is two print pages of the corresponding format in width.

For the present case of the multiple-width, such as, for example, double-width or, in this case triple-width, first printing units 02, a longitudinal cutting device, which is not specifically shown here, is provided in the web path between the first printing unit 02 and the former assembly 07; 07'. With a printing unit 02 that is n-times, wherein n=2, 3, . . . in configuration, the forme cylinder 04 supports 2*n print pages of a certain format, especially a newspaper format, side by side in an axial direction in one operating mode, for example, and the longitudinal cutting device is structured, for example, to cut a web 11; 21 that has been printed by this printing unit 02 lengthwise into n partial webs 11.1; 11.2; 11.3. The printing unit or units 03 of the second type is or are m-times, wherein m=1, 2, 3, . . . ; with m<n in configuration. The forme cylinder 04 supports 2*m print pages, especially printing forms with printing pages, of a certain format, especially a newspaper format, side by side in an axial direction in one operating mode, for example. The newspaper format can be either the same as the first-named, or, for pop-up production, as will be discussed below, can be a newspaper format that is different from the first.

In principle, the longitudinal cutting device can be arranged in the web path of the web 11 coming from the first printing unit 02, and situated upstream from the turning device 10. In this case, the already narrow, for example, only two pages in width partial webs 11.1; 11.2; 11.3, are to be fed over the turning device or devices 10 to the formers 09; 09'. However, it is also possible for a longitudinal cutting device to be provided upstream, with which longitudinal cutting device, the web 11 is now cut first into a multiple-width partial web, for example, a double-width, partial web 11.1, and into a single-width partial web 11.2. A multiple-width partial web 11.2 can be m-times wide, and thus can have a width corresponding to the m-width second printing unit 03. In the turning of multiple-width partial webs 11.1, in contrast to the turning of only single-width partial webs 11.2, the web lead is more stable. The multiple-width partial web 11.1 is then cut lengthwise into single-width partial webs, such as, for example, into two print pages side by side before running up to the former assembly 07; 07'.

With a turning of multiple-width, such as, for example, m-width, partial webs 11.1, the turning device 10 has at least one multiple-width, such as an m-width "multiple-width" turning bar 32'.

Figure 7:
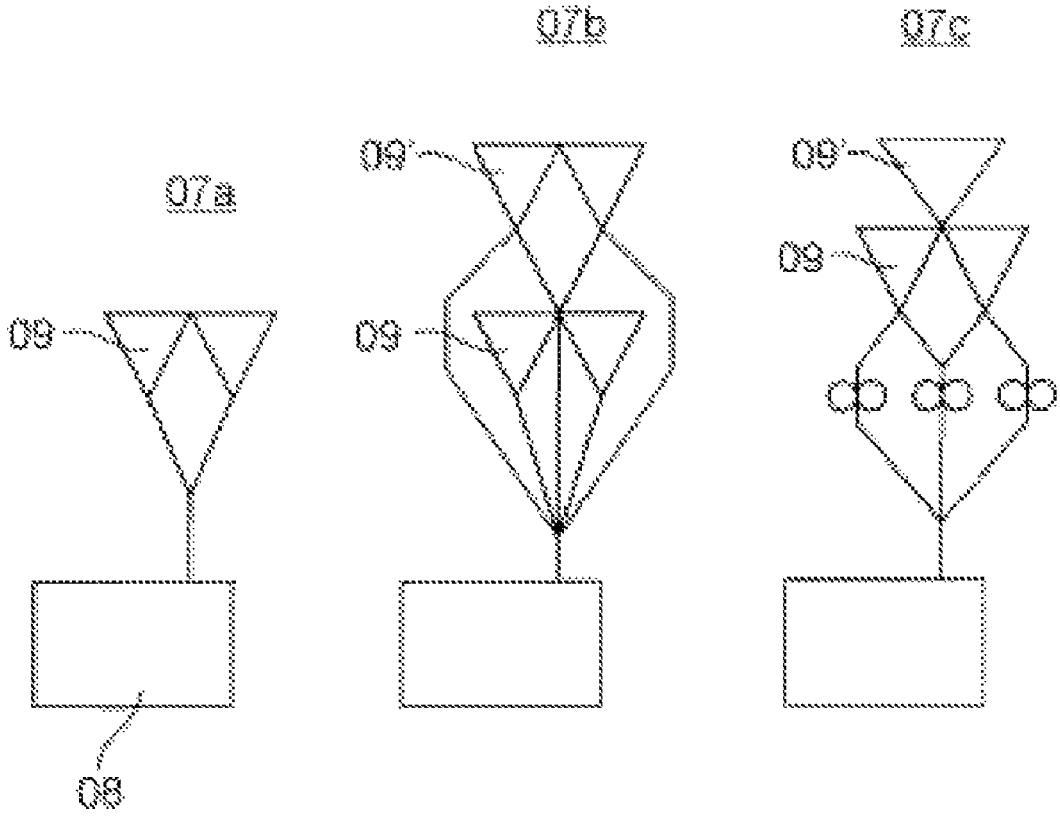
FIG. 7 schematic representations of former assemblies for use in the printing press system of the present invention.

FIG. 7 shows various alternative configurations for a double-width former assembly 07, at least in a certain print page format. The configuration of former assembly 07*a* has one former group of two fold formers 09 arranged side by side, transversely to the run-up direction of a web 21, with the two fold formers 09 being positioned in only a single plane. The effective width of these two fold formers 09 corresponds, for example, maximally, to the effective cylinder length of a forme cylinder 14 of the printing unit 03, which forme cylinder 14 is arranged upstream from the former assembly 07 in a straight-line configuration. The folder 08 is arranged downstream from the former group of two formers 09. In the configuration of the former assembly 07*c*, that former assembly additionally has longitudinal cutting devices, which are not specifically shown, and which are situated in the web path, upstream or downstream from the fold formers 09, for use in cutting the partial webs 21.1; 21.2 at the center, lengthwise, in the area of the fold spine of the longitudinally folded ribbon. These partial ribbons from the same fold former 09, which have been cut apart along the fold spine and which are then laid one upon another, can now be separated and compiled, as needed, with a ribbon, or with a partial ribbon from an adjacent fold former 09 via guide rollers and/or nip rollers. This is particularly advantageous when a further processing stage, such as a gluing device or a stitching device, is or are on one or more of the possible ribbon guides between the fold formers 09 and the folder 08. In this manner, and based upon the distribution of the ribbons, the partial ribbons can be variably assigned to stitched or unstitched ribbons and/or to glued or unglued ribbons.

In the configuration of the former assembly 07b, again as depicted schematically in FIG. 7, the former assembly, has two former groups of two fold formers 09; 09'each, positioned side by side, with the two former groups being situated in two vertical planes that are offset from one another.

In one configuration of the former assembly 07, which is shown in FIG. 7*c*, the former assembly 07 can have two groups of fold formers, arranged one above another, with a different number of fold formers arranged side by side horizontally as a former group, and/or can have two groups of fold formers, each having a different effective width or former format. For example, a first of the groups of fold formers 09 is double-width in configuration, in terms of a first print page format, and, with respect to this print page format, has two single-width fold formers 09, whereas, as shown, a single, significantly wider fold former arranged above or below this wider fold former 09. In this context, what was stated above applies to the effective width. With a configuration of this type for the former assembly 07, a pop-up product can also be produced in connection with the two printing presses 01; 31.

In the preferred embodiment of the present invention, as depicted in FIG. 1, the second printing press 31 has one printing unit 03 of the second type and, in the machine alignment M2, has at least one, and in this case, has two former assemblies 07; 07'. In the view of FIG. 3, the printing press system is shown from the perspective of a longitudinal side of the second printing press 31, and in the view of FIG. 2, the same printing press system is shown from a longitudinal side of the first printing press 01.

Here, the printing units 02 of the first type are configured as printing towers 02, each with two stacked H-printing units and with one additional bridge printing unit. The printing units 02 of the first type are triple-width in configuration with respect to one format, and especially with respect to a newspaper format so that they have six print pages side by side axially on their circumference. Advantageously, these printing units 02 are configured with a double circumference, and thus are double-sized, as discussed above. At least one reel changer 12 is situated upstream from the printing unit 02 of the first type and, especially in parterre arrangement, is arranged in the same plane as the printing unit 02.

In addition to the second printing press 31, two first machine lines 30 are arranged in the above-described manner, orthogonally to the second printing press 31, as seen in FIG. 1. Each of the first machine lines 30 has a plurality of printing units 02 of the first type, in this case, two such first printing units 02. The printing unit 03 of the second type is configured, as seen in FIG. 3, as a printing tower 03 with two stacked H-printing units. The printing unit 03 of the second type is narrower in configuration than is the printing units 02 of the first type. Here, the printing unit 03 is double-width in configuration. Based upon one newspaper page, this second printing unit 03 can be single circumference or double circumference in configuration. A reel changer 26 is situated upstream from the printing unit 03 of the second type, especially in parterre arrangement, and is thus arranged in the same plane as the printing unit 03. A dryer 15 is situated downstream from the printing unit 03 of the second type.

In the operational situation shown primarily in FIG. 1, a single-width partial web 11.1 and/or a multiple-width partial web 11.2 from the first printing press 01, which has been cut lengthwise from web 11, before reaching the turning device 10, is turned 90° over a turning bar 32; 32' of the turning device 10, and is fed into the alignment of a single width partial web 21.1 or of a multiple-width partial web 21.2 from the second printing press 31 and is then directed to a former assembly 07. In the example shown in FIG. 1, a multiple-width partial web 11.2; 11.3 and/or two single-width partial webs 11.1; 11.3 from a first, full web 11, that is coming from a wider, first printing press 01, is taken to cooperate with partial webs 21.1; 21.2 from a second, full web 21 coming from a narrower, second printing press 31, and wherein the web width of the uncut first web 11 is wider than the web width of the uncut second web 21.

In concrete terms, here one or more partial webs 11.1; 11.2; 11.3 from a triple-width first full web 11 are turned 90° into the alignment of a double-width printing press 31 or to an only double-width former assembly 07. In general terms, a partial web 11.1; 11.2; 11.3 from an n-width web 11 from an n-width first printing press 01 is turned 90° into the alignment of an (n−1)-width printing press 31 and/or is fed to an (n−1)-width former assembly 07.

In FIG. 3, options for the web lead for the web 21, which is passing through the dryer 15, are shown. The web 21 can be fed, as a cover section, to one of the fold formers 09; 09'. The partial webs 11.1; 11.2 coming from the first printing units 02 and being turned via the turning devices 10 are indicated here only by arrows. The webs 21 or the partial webs 21.1; 21.2 coming from the second printing unit 03 can thus be fed, as a cover section, to one or more of the partial webs 11.1; 11.2.

In the preferred embodiment depicted in FIG. 1 through FIG. 3, and beginning with the second printing unit 03, as viewed in the machine alignment M2, the second printing unit 03, a turning device 10, a first former assembly 07, a second turning device 10 and a second former assembly 10' are provided in sequence.

The compact arrangement of the configuration of the parallel first machine lines 30 offers advantages with respect to a reel supply system, such as, for example, a track system, which reel supply system is outlined in the figures, but which is not assigned a particular reference symbol, and in which track system, transport carriages, for use in transporting reels of material, can be moved. The compact arrangement also enables shorter paths in operating the adjacent machine lines 30 of the first printing press 01.

Figure 4:
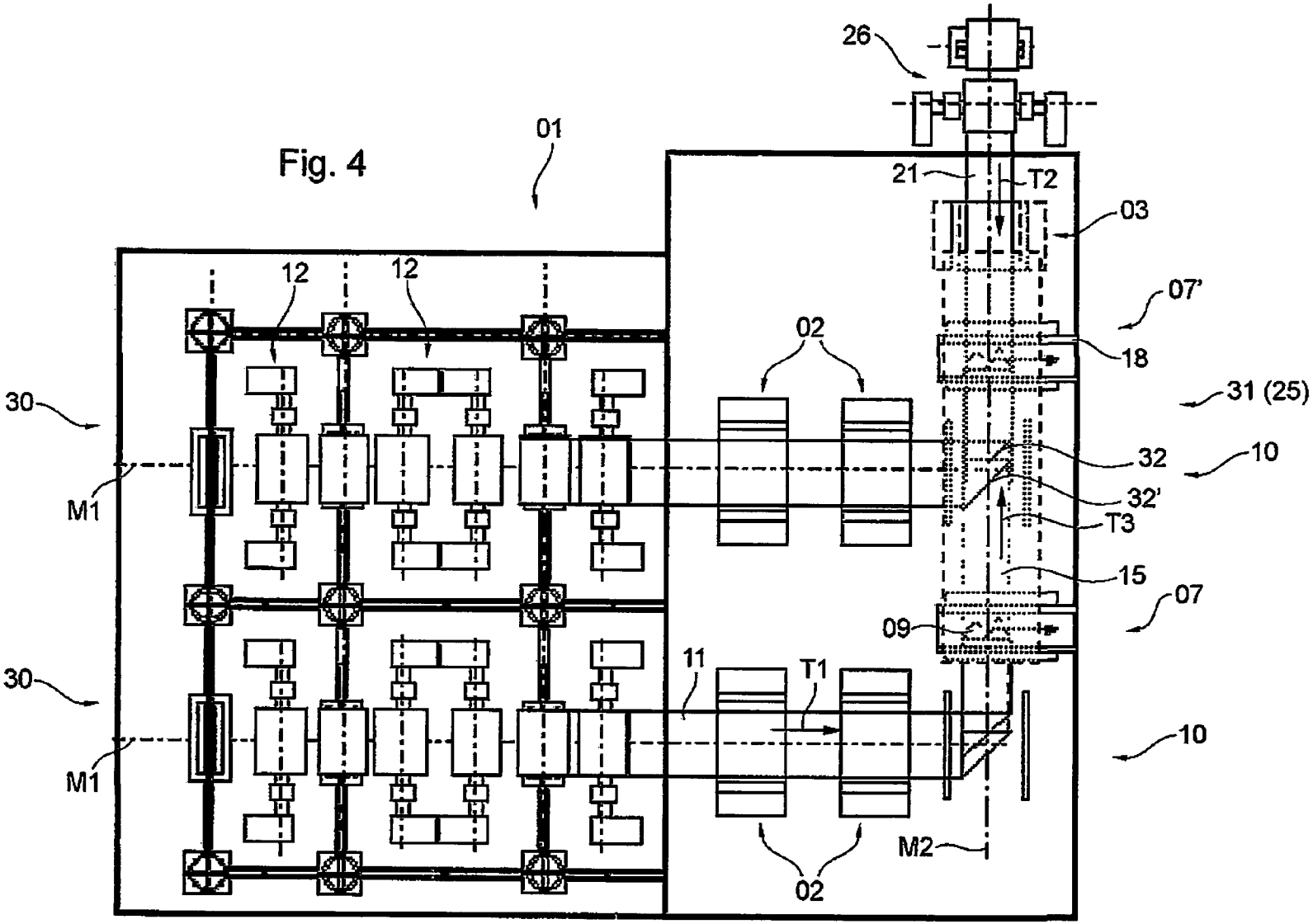
FIG. 4 a schematic top plan view of a second preferred embodiment of a printing press system in accordance with the present invention.

In contrast to the first preferred embodiment depicted in FIGS. 1-3, the second preferred embodiment, as shown in FIG. 4, and beginning with the second printing unit 03, as viewed in the second machine alignment M2, is provided with the printing unit 03, with a first former assembly 07, with a turning device 10, with a second former assembly 07' and with a second turning device 10, in sequence. Otherwise, what has been stated with respect to FIG. 1 through 3 can be applied to the assembly of FIG. 4.

Figure 5:
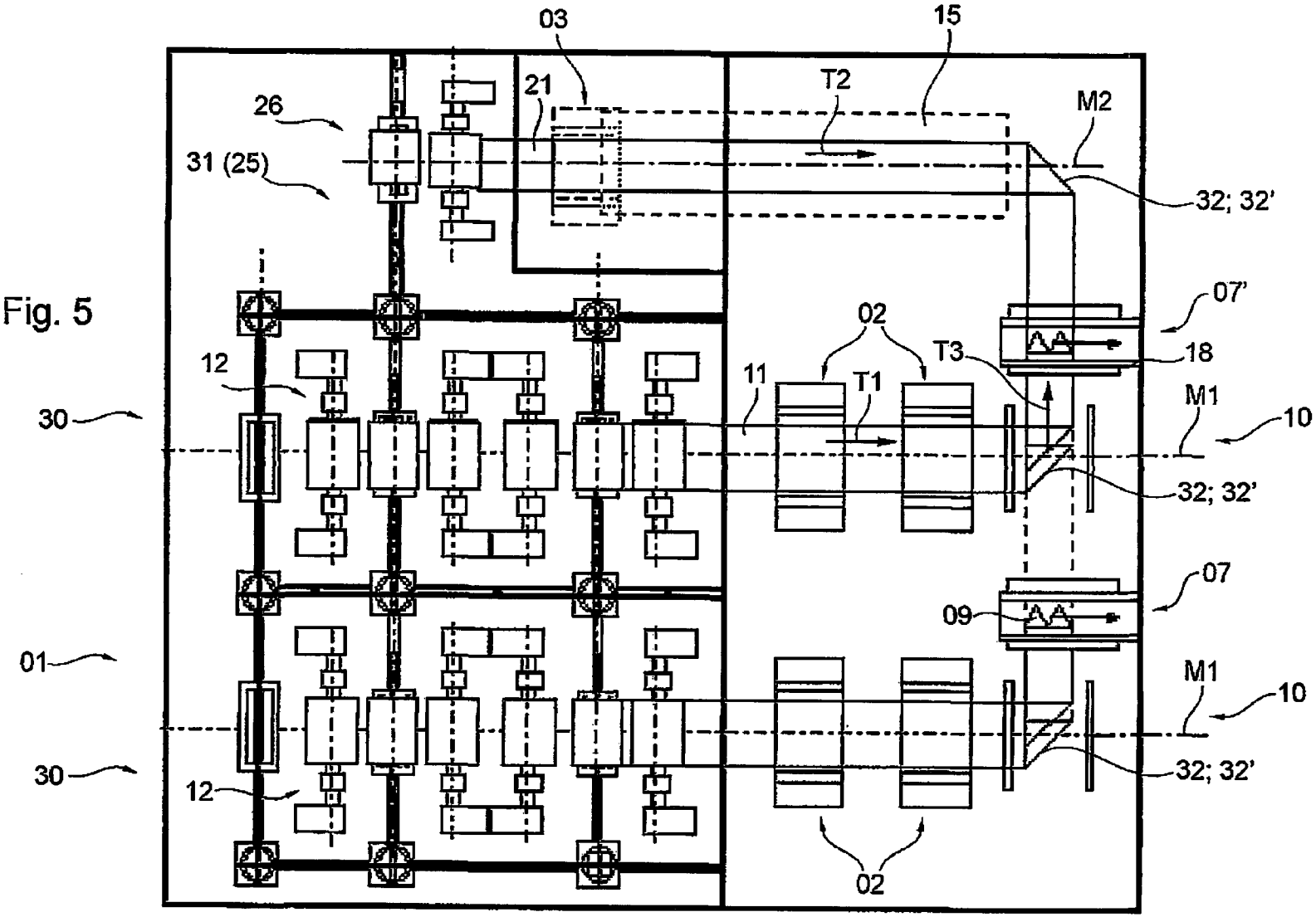
FIG. 5 a schematic top plan view of a third preferred embodiment of a printing press system in accordance with the present invention.
Figure 6:
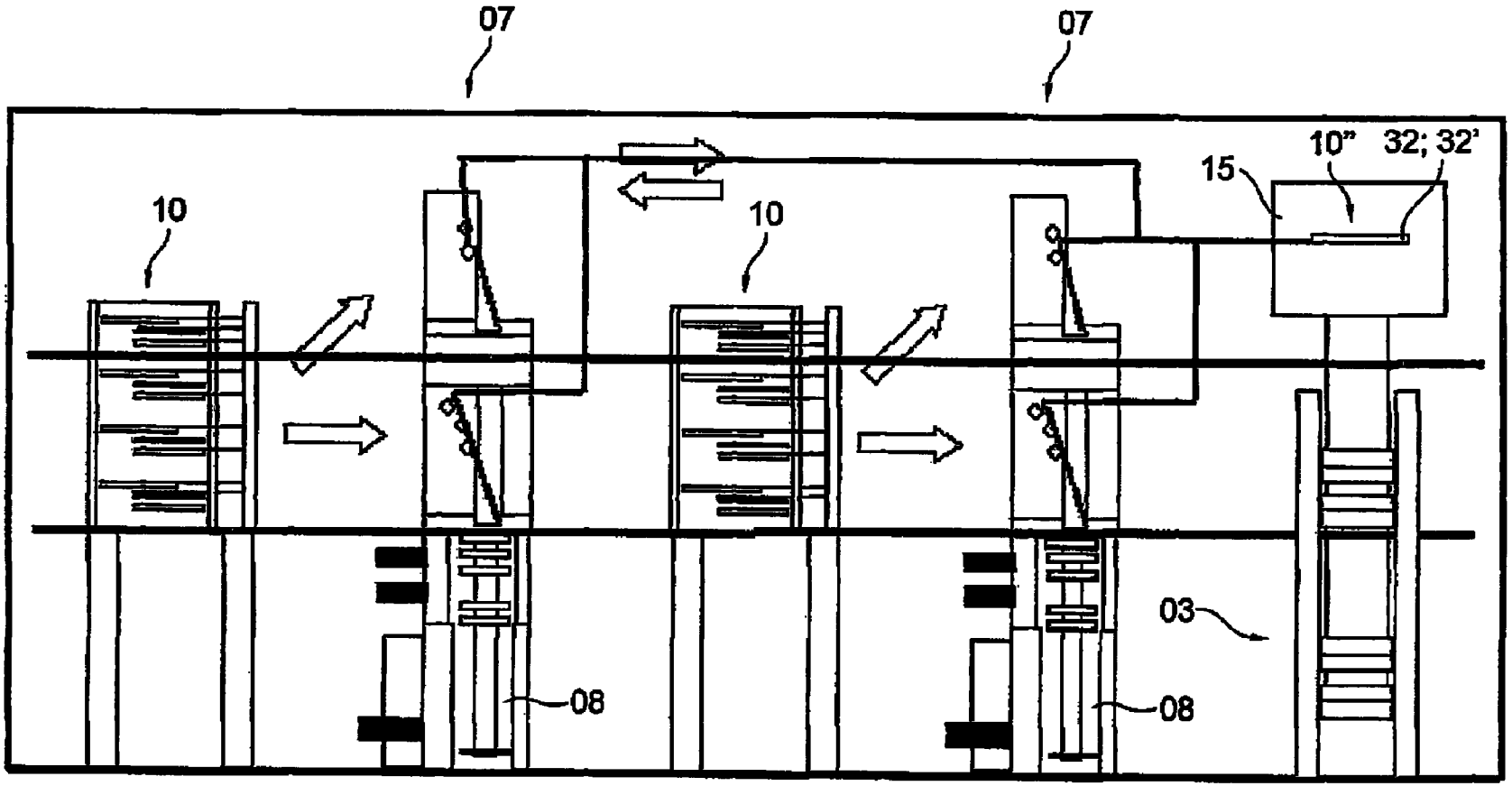
FIG. 6 a first side elevation view of the printing press system of FIG. 5.

In a configuration of a third preferred embodiment that is different from the first two embodiments shown in FIG. 1 to FIG. 4, in FIGS. 5 and 6 a configuration is presented, in which a partial web 11.1; 11.2; 11.3 of an n-width web 11 is also turned 90° into the alignment of an only (n−1)-width former assembly 07. In contrast to the first two examples, however, the machine alignment M2 of the second printing press 31, which has the second printing unit 03, extends not orthogonally, but instead, extends parallel to the first machine alignment M1. Here again, the first printing units 02 are structured in 6/1 or 6/2 configuration, whereas the printing unit 03 of the second type is structured in 4/1 or 4/2 configuration.

The webs 11, which are coming from the printing units 02 of the first type, are again cut into partial webs 11.1; 11.2, of either single or double-width, and are fed to a former assembly 07, the lead-in direction T3 of which former assembly 07, when projected into the horizontal plane, is parallel to the longitudinal direction of the printing group cylinders 04; 06 or is perpendicular to the machine alignment M1 of the first printing unit 02. The second printing press 31 or machine line 30 is preferably also configured here with a dryer 15.

The web 21, which is coming from the second machine line 25 is then turned 90°, either as a double-width web 21 over a double-width turning rod 32 of an additional turning device 10", or as single-width partial webs 21.1; 21.2, which have already been cut lengthwise, over two single-width turning bars 32, and are taken into the alignment of the lead-in direction T3 or an alignment of the former assembly 07, which is parallel to the previous alignment. As with the two previously discussed embodiments, the partial webs 21.1; 21.2 that have been printed by the second printing unit 03 can be fed to one or more fold formers 09; 09' as a cover section for one or more partial webs 11.1; 11.2 that have been printed by the first printing units 02.

FIG. 6 shows a side elevation view of the printing press system from a side of the former assemblies 07.

For all of the above-discussed preferred embodiments of the printing press system in accordance with the present invention, a further improvement provides for the configuration of at least one of the printing units 02; 03 and/or for the one former assembly 07; 07' to produce so-called "pop-up" products.

To this end, in a first configuration, which is not specifically shown here, a former assembly 07 can be configured with two groups of fold formers 09; 09', the effective widths of which differ and which are therefore configured for folding partial webs 11.1; 11.2; 11.3; 21.1; 21.2 of different widths. In a further improvement, fold formers 09; 09' of at least one of the two former groups of fold formers 09', 09' can be structured to be movable in a direction transversely to the web travel direction, for example, in a direction transversely to the transport direction T3, and, if applicable, to be adjustable in terms of their effective widths by using removable and/or fold-away inserted pieces. Based upon the partial web width, the two adjacent fold formers 09; 09' can then be placed in a position relative to one another such that a distance between the former peaks can be different by a variable adjustment to the partial web width.

In another variation which is not specifically shown, the fold formers 09; 09' having the greater, maximum required effective width, for example corresponding to the representation of FIG. 7, can be permanently installed.

While preferred embodiments of a printing press system, in accordance with the present invention, have been set forth fully and completely hereinabove, it will be apparent to one of skill in the art that various changes in, for example, the drives for the printing presses, the specific structure of the reel changers, and the like could be made without departing from the true spirit and scope of the subject invention which is accordingly to be limited only by the appended claims.

What is claimed is:

1. A printing press system comprising:

at least one printing unit;

a plurality of printing groups arranged one above the other in said at least one printing unit as a printing tower and being usable for double-sided, multicolor printing of a web of material;

a forme cylinder in each said printing group and having a forme cylinder longitudinal axis of rotation, each said forme cylinder having a forme cylinder circumferential surface with a circumferential length and width;

a printing forme mounting channel in said circumferential surface of each said forme cylinder and extending over said forme cylinder circumferential width, each said forme cylinder being adapted to receive printing form extending over said forme cylinder circumferential width;

a former assembly positioned after, in a direction of travel of said web of material, said at least one printing unit, said former assembly having a material web feed-in direction parallel to said forme cylinder axis of rotation:

at least first and second fold formers located side by side in a common plane in said former assembly and transversely to said web feed-in direction, said at least first and second fold formers being supported for relative movement for varying a spacing distance between first and second fold formers transverse to said material web feed-in direction;

at least one turning device positioned intermediate said at least one printing unit and said former assembly and having at least one turning bar usable to turn said web of material 90° and to transfer said web of material printed in said at least one printing unit to said former assembly; and a dryer arranged, in said direction of travel of said web of material, intermediate said at least one printing unit and said at least one turning device.

2. The printing system of claim 1 wherein said at least one printing unit is a multiple width printing unit having a circumferential width of each said forme cylinder of a plurality of printing pages.

3. The printing system of claim 1 wherein each said forme cylinder has a circumferential width of six printed pages.

4. The printing system of claim 1 wherein said at least one turning bar is a multiple-width turning bar.

5. The printing system of claim 1 including a transfer cylinder in each said printing group and having a transfer cylinder width the same as said forme cylinder width.

6. The printing system of claim 5 further including a blanket on said transfer cylinder and extending over said transfer cylinder width.

7. The printing system claim 1 wherein said former assembly further includes a third fold former positioned selectively one of above and below said first and second fold formers, said first fold former having a first former width, said second fold former having a second former width equal to said first former width, and third fold former having a third former width greater than said first former width and greater than said second former width.

* * * * *